US006905378B2

(12) United States Patent
Uraki et al.

(10) Patent No.: US 6,905,378 B2
(45) Date of Patent: Jun. 14, 2005

(54) ENGINE CONTROL UNIT

(75) Inventors: Mamoru Uraki, Wako (JP); Takao Kochi, Wako (JP); Masahiko Tsuchiya, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/827,938

(22) Filed: Apr. 19, 2004

(65) Prior Publication Data

US 2004/0224579 A1 Nov. 11, 2004

(30) Foreign Application Priority Data

Apr. 23, 2003 (JP) ..... 2003-118353

(51) Int. Cl.[7] ..... B60K 41/00
(52) U.S. Cl. ..... 440/1; 440/38; 440/84
(58) Field of Search ..... 440/1, 2, 84, 85, 440/86, 87, 41, 42, 38

(56) References Cited

U.S. PATENT DOCUMENTS 6,124,809 A * 9/2000 Boudriau ..... 340/984
6,428,371 B1 * 8/2002 Michel et al. ..... 440/38
6,551,152 B2 4/2003 Matsuda et al.

FOREIGN PATENT DOCUMENTS

JP 2001-329881 11/2001
JP 2002-87390 3/2002

* cited by examiner

*Primary Examiner*—Stephen Avila
(74) *Attorney, Agent, or Firm*—Merchant & Gould P.C.

(57) ABSTRACT

To provide an engine control unit for facilitating steering control. In particular, the invention relates to a controller of a boat propelled by jetting water pressurized and accelerated by a water jet pump. If a throttle angle of an engine for driving the water jet pump is a predetermined value or less and a steering angle by a steering handlebar of the jet propulsion boat is a predetermined value or more, a throttle valve of the engine is operated in an opened direction and advance angle control is made over the normal ignition timing of the engine.

3 Claims, 8 Drawing Sheets

(PRIOR ART)

ENGINE CONTROL UNIT

CROSS REFERENCE TO RELATED APPLICATIONS

This application claims priority to Japanese patent application No. 2003-118353 filed on Apr. 23, 2003.

FIELD OF THE INVENTION

The present invention relates to an engine control unit of a jet propulsion boat that jets water that is pressurized and accelerated by a jet pump therein.

BACKGROUND OF THE INVENTION

In a boat propelled by jetting water pressurized and accelerated by a water jet pump, as thrust is decreased to a state in which a throttle valve is fully closed (an off-throttle state) during operation, the cornering performance is deteriorated. For technique for solving this problem, technique for controlling the speed of an engine for driving the water jet pump using handlebar off-steering information as a trigger heretofore exists.

For example, as described in Japanese Patent No. 2001-329881 and Japanese Patent No. 2002-87390, the cornering performance can be improved by increasing engine speed based upon steering angle and boat speed.

However, in the conventional examples, as shown in FIG. 8, the target engine speed of an off-throttle steering system (OTS) may be unable to be achieved depending upon a throttle angle. For example, in an example shown in FIG. 8, in case a throttle angle is 5°, engine speed can be enhanced up to the target engine speed of OTS which is slightly higher than engine speed in idling. However, as engine speed cannot be enhanced up to the target engine speed of OTS in case a throttle angle is 3°, control over steering may be difficult. Therefore, it would be beneficial to measure steering. Such a device would preferably be reliable, light weight, and inexpensive.

BRIEF SUMMARY OF THE INVENTION

The invention relates to an engine control unit for a boat propelled by jetting water pressurized and accelerated by a water jet pump. The engine control unit measures throttle and steering. If the throttle is low and the steering is sharp, the engine control unit opens the throttle valve so that the boat can more efficiently perform the desired turn. More specifically, if the throttle angle of the engine for driving the water jet pump is a predetermined value or less and a steering angle by the steering handlebar of the jet propulsion boat is a predetermined value or more, the throttle valve of the engine is operated in the opened direction and advance angle control can be made over the ignition timing of the engine.

DETAILED DESCRIPTION OF THE INVENTION

Figure 1:
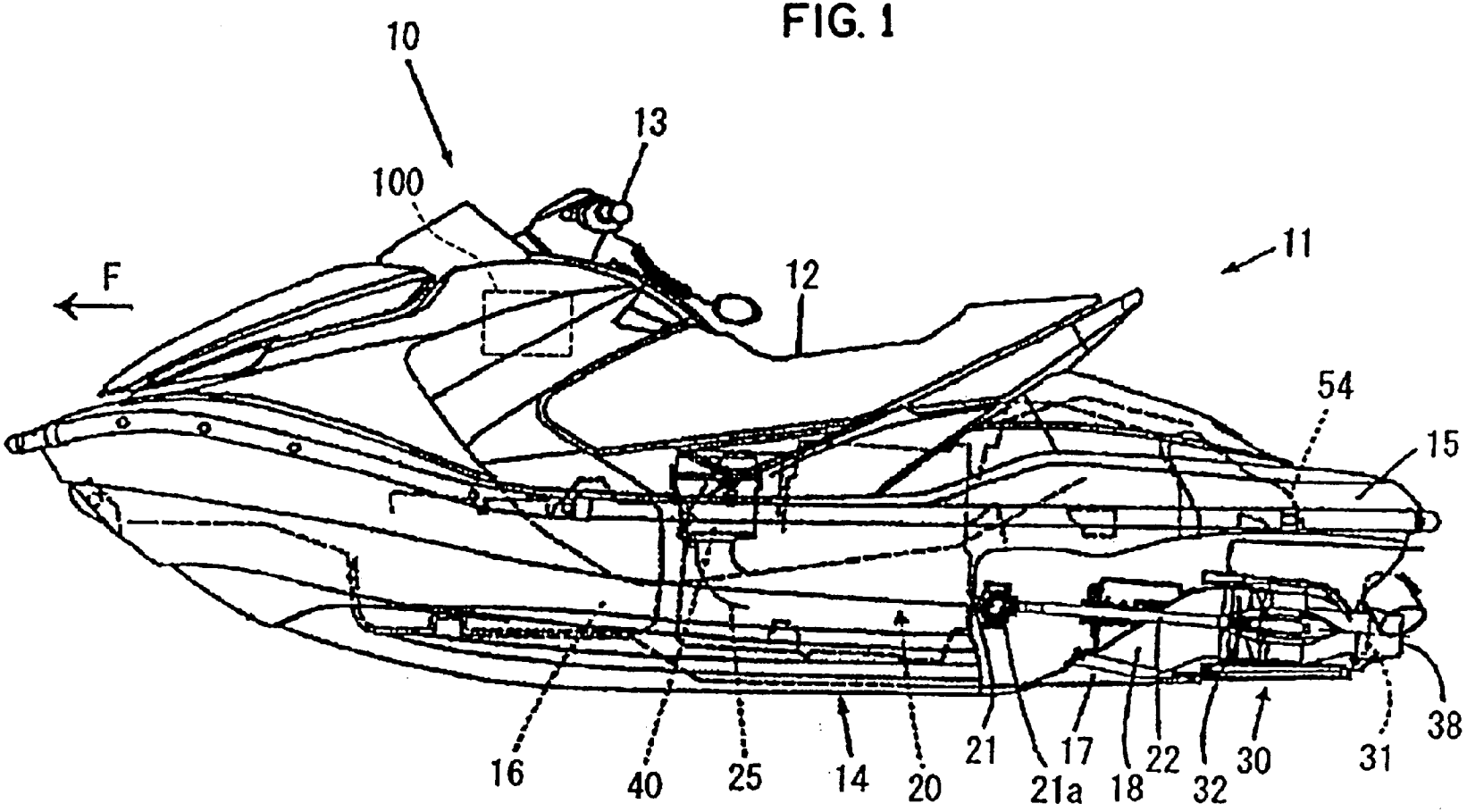
FIG. 1 is a side view a part of which is cut out showing a jet propulsion boat mounting an engine output controller equivalent to this embodiment.
Figure 2:
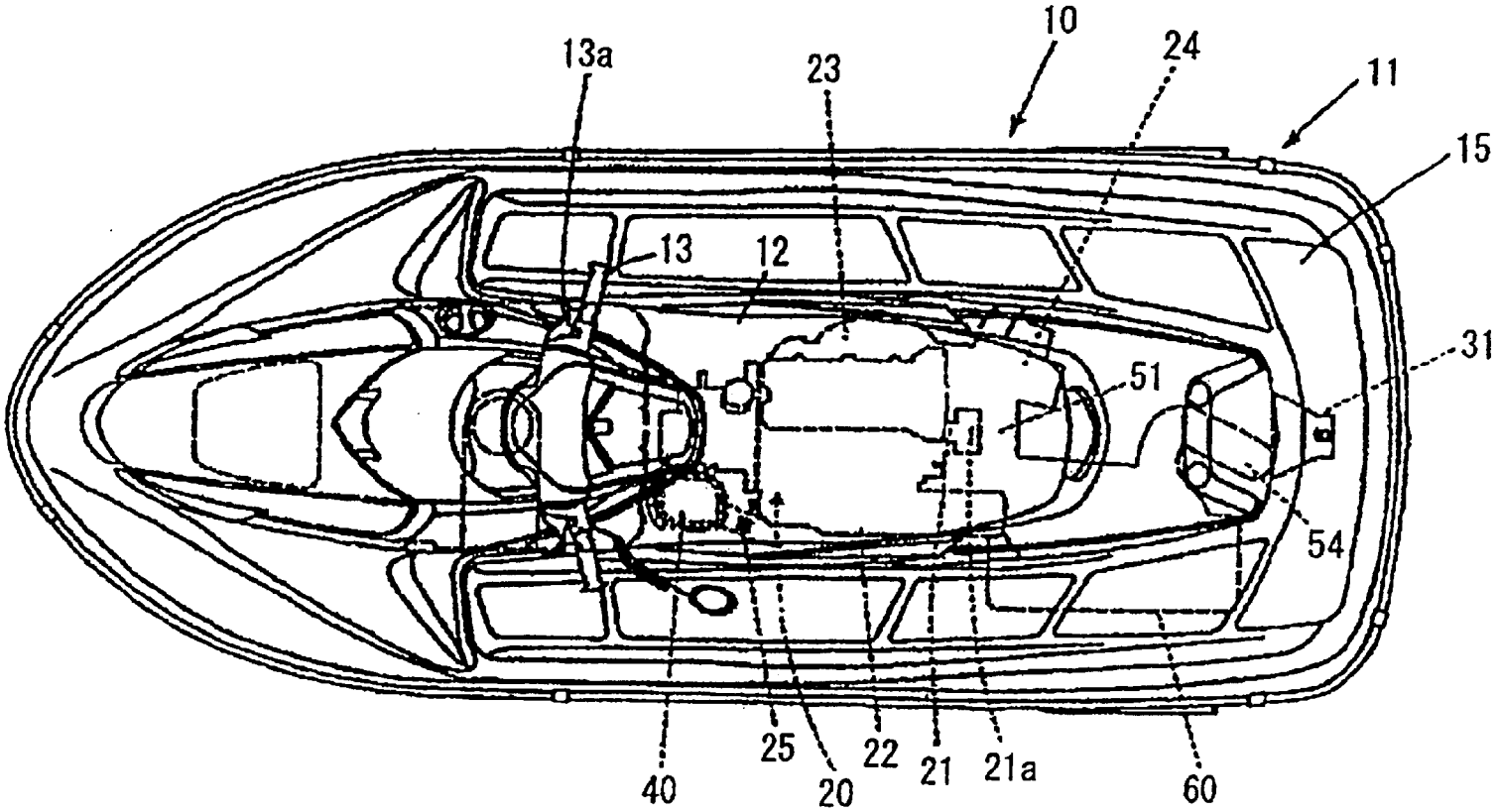
FIG. 2 is a plan showing the same jet propulsion boat.

Referring to the drawings, one embodiment of an engine control unit according to the invention will be described below. FIG. 1 is a side view a part of which is cut out showing a personal water craft (PWC) mounting an engine output controller equivalent to this embodiment and FIG. 2 is a plan showing the same boat.

As shown in these drawings (mainly FIG. 1), the personal water craft 10 is a saddle-type small-sized boat, a crew sits on a seat 12 on the body 11, and the output of an engine 20 is adjusted by gripping and operating a steering handlebar 13 with a throttle lever and adjusting an opening of a throttle valve (not shown) of the engine 20.

The body of the boat 11 has floating structure acquired by bonding a hull 14 and a deck 15 and forming space 16 inside. In the space 16, the engine 20 is mounted above the hull 14 and a water jet pump 30 as propelling means driven by the engine 20 is provided to the rear of the hull 14.

The water jet pump 30 is provided with an impeller 32 arranged in a duct 18 extended from an intake 17 open to the bottom to a deflector 38 via an exhaust nozzle 31 open to the rear end of the body, and a shaft (a drive shaft) 22 for driving the impeller 32 is coupled to the output shaft 21 of the engine 20 via a coupler 21*a*.

Therefore, when the impeller 32 is rotated by the engine 20 via the coupler 21*a* and the shaft 22, water taken in from the intake 17 is jetted from the exhaust nozzle 31 via the deflector 38 and hereby, the body 11 is propelled.

The number of revolutions of the engine 20, that is, propelling force by the water jet pump 30 is operated by the turning operation of the throttle lever 13*a* (see FIG. 2) of the steering handlebar 13. The deflector 38 is linked with the steering handlebar 13 via operating wire not shown, is turned by the operation of the handlebar 13 and hereby, a course of the body 11 can be changed.

Figure 3:
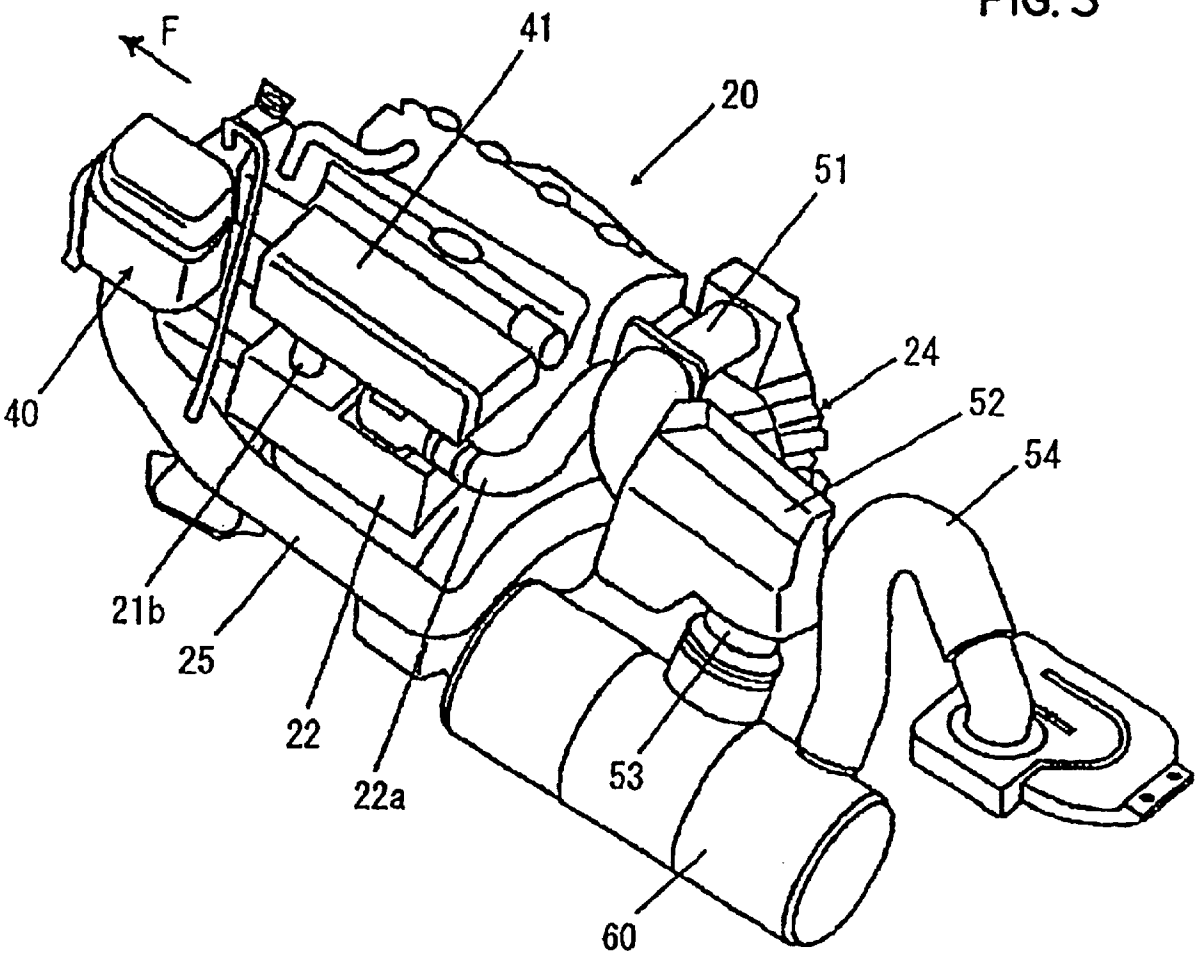
FIG. 3 is a schematic perspective view mainly showing an engine and a turbocharger.

FIG. 3 is a schematic perspective view mainly showing the engine 20.

The engine 20 is a DOHC-type in-line four-cylinder dry sump-type four-cycle engine and its crankshaft (see the output shaft 21 shown in FIG. 1) is arranged along the longitudinal direction of the body 11.

As shown in FIGS. 1 to 3, a surge tank 41 and an inter-cooler 22 are connected and arranged on the left side of the engine 20 in the traveling direction F of the body 11 and an exhaust manifold 23 is arranged on the right side of the engine 20.

A turbocharger 24 for feeding compressed intake air to the engine 20 is arranged at the back of the engine 20 and an air cleaner case 40 for taking new air in the turbocharger 24 via a pipe 25 is arranged in front of the engine 20.

An exhaust outlet of the exhaust manifold 23 (see FIG. 2) is connected to a turbine of the turbocharger 24. Besides, the inter-cooler 22 is connected to a compressor of the turbocharger 24 via a pipe 22*a* and the surge tank 41 is connected to the inter-cooler 22 via a pipe 21*b*. Therefore, after new air from the air cleaner case 40 is supplied to the turbocharger 24 via the pipe 25, is compressed in its compressor and is supplied and cooled to/in the inter-cooler 22 via the pipe 22*a*, the new air is supplied to the engine 20 via the surge tank 41.

Exhaust gas which fulfills the role of turning the turbine of the turbocharger 24 is exhausted into a water muffler 60 via a first exhaust pipe 51, a back flow preventing chamber 52 for preventing the back flow of water in a turnover (the penetration of water into the turbocharger 24 and others) and a second exhaust pipe 53, and is further exhausted into a stream made by the water jet pump 30 from the water muffler 60 via an exhaust gas/waste water pipe 54.

An engine speed sensor that detects the engine speed is provided to the engine 20. Besides, a boost pressure sensor that detects boost pressure is provided to the turbocharger 24. The engine speed sensor and the boost pressure sensor are connected to a controller 100 (an engine output controller) mounted in the jet propulsion boat 10. Measured values sensed by these sensors are regularly output to the controller 100.

Figure 4:
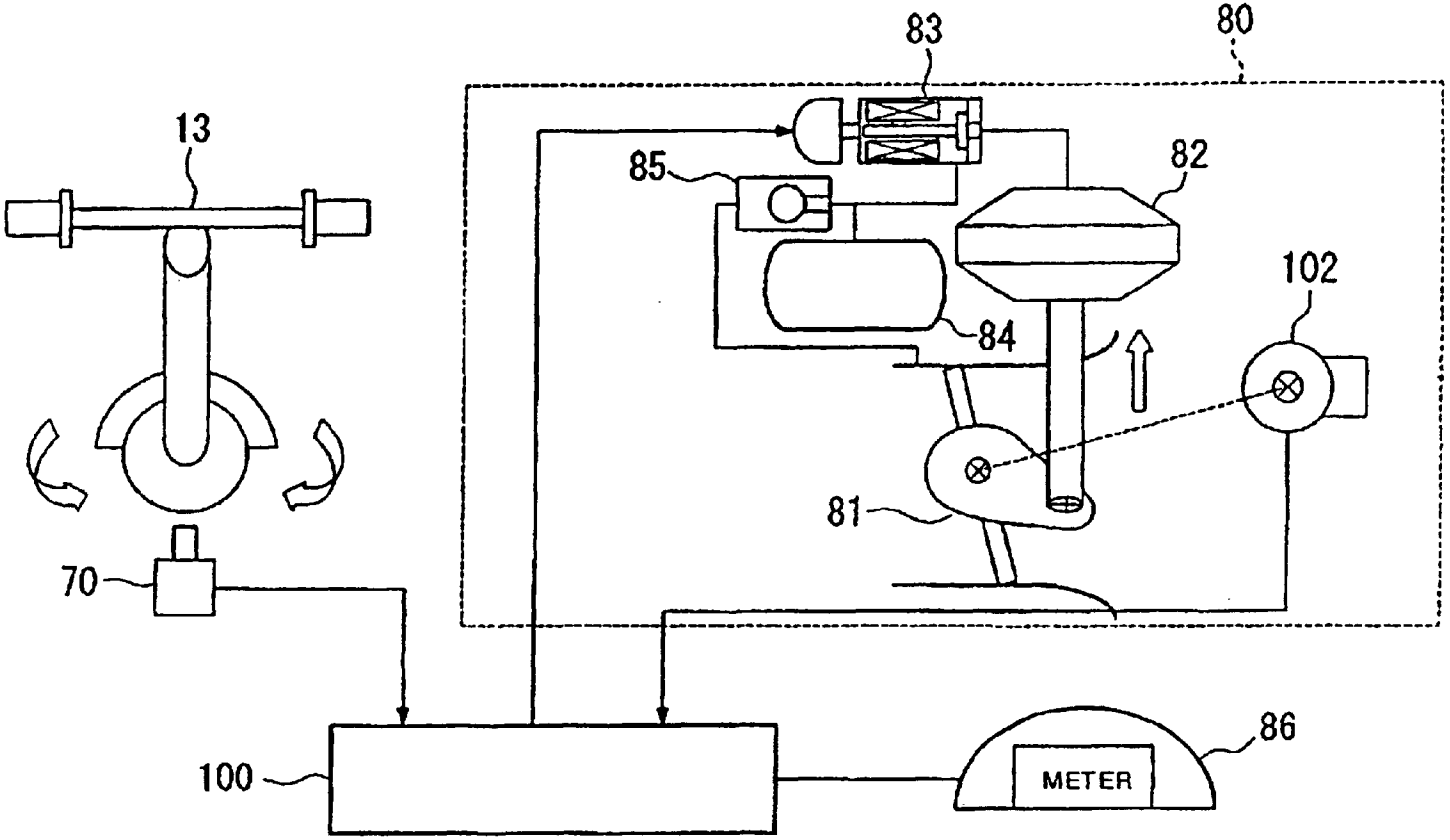
FIG. 4 shows the configuration of OTS of the jet propulsion boat mounting the engine output controller equivalent to this embodiment.

FIG. 4 is a block diagram showing an off-throttle steering system (OTS) of the jet propulsion boat 10.

A full steering switch 70 is provided to the steering handlebar 13 as a steering angle sensor and outputs a measured value of a steering angle or the on/off of the full steering switch to the controller 100. A throttle body 80 for opening/closing a throttle valve 81 interlocked with the throttle lever 13*a* that supplies suitable air quantity to the engine 20 to control the output is provided to the engine 20. A throttle angle sensor 102 for detecting an angle of the throttle valve 81 is provided to the throttle body 80 and outputs a measured value of the throttle angle to the controller 100.

The throttle valve 81 is connected to a diaphragm actuator 82 and is opened/closed by the drive of the diaphragm actuator 82. The diaphragm actuator 82 is connected to the surge tank 84 via a solenoid (an electromagnetic valve) 83 and is driven according to the on/off of the solenoid 83. The surge tank 84 is connected to an air intake duct via a one-way valve 85 in the rear of the throttle valve 81.

An OTS indicator 86 showing an on/off state of OTS is provided in a meter in front of the steering handlebar 13.

The controller 100 is an engine control unit (ECU) that controls the engine 20 and others and is connected to a fuel injection system and an igniter provided to the engine 20.

The fuel injection system injects fuel under the control of the controller 100. The igniter similarly ignites fuel under the control of the controller 100.

Figure 5:
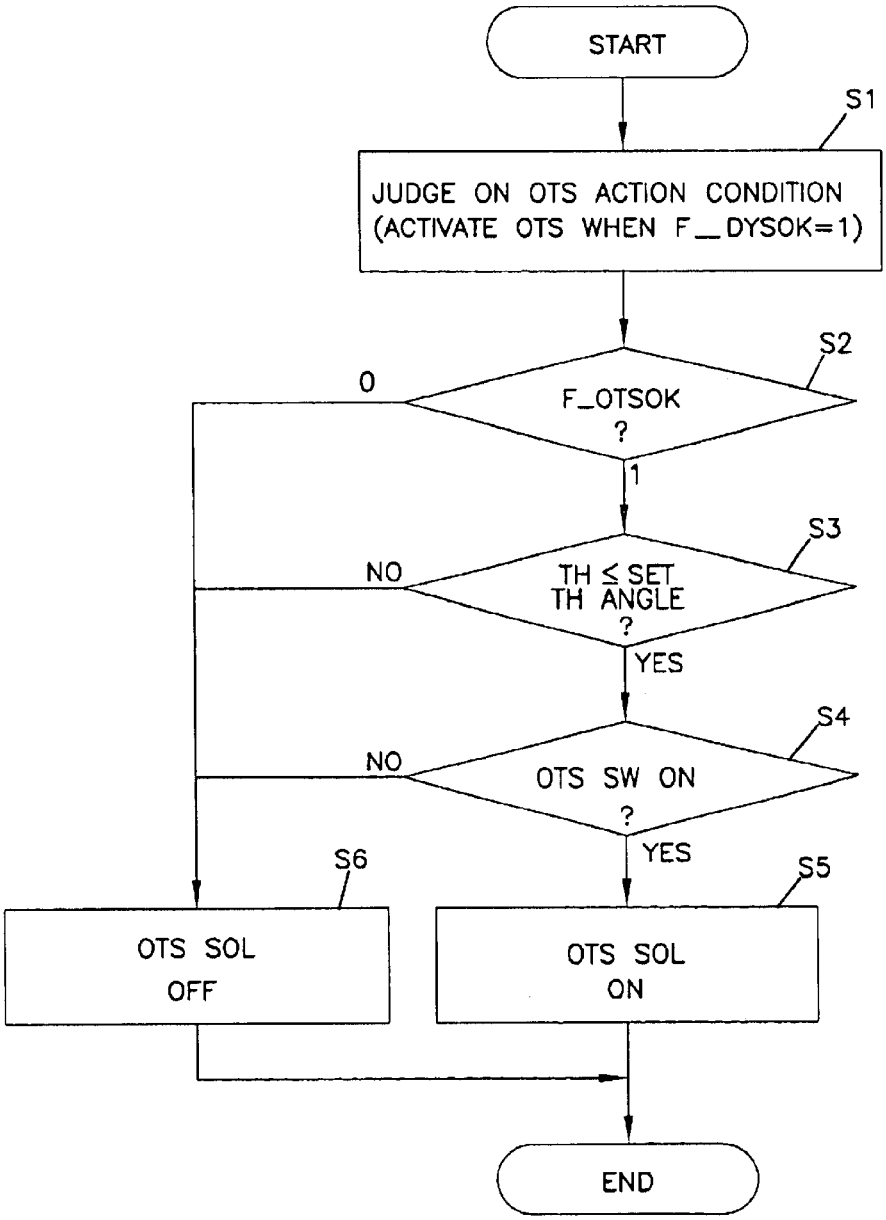
FIG. 5 is a flowchart showing OTS control.

Next, referring to the drawings, the operation of the engine control unit (the controller 100) equivalent to this embodiment will be described. FIG. 5 is a flowchart showing a process of OTS control processing by the engine control unit equivalent to this embodiment.

First, the controller 100 receives each measured value of engine speed NE, a throttle angle TH, and a steering angle respectively input from the engine speed sensor, the throttle angle sensor 102 and the full steering switch 70 and compares them with an OTS action condition (a step S1 in FIG. 5).

Figure 6:
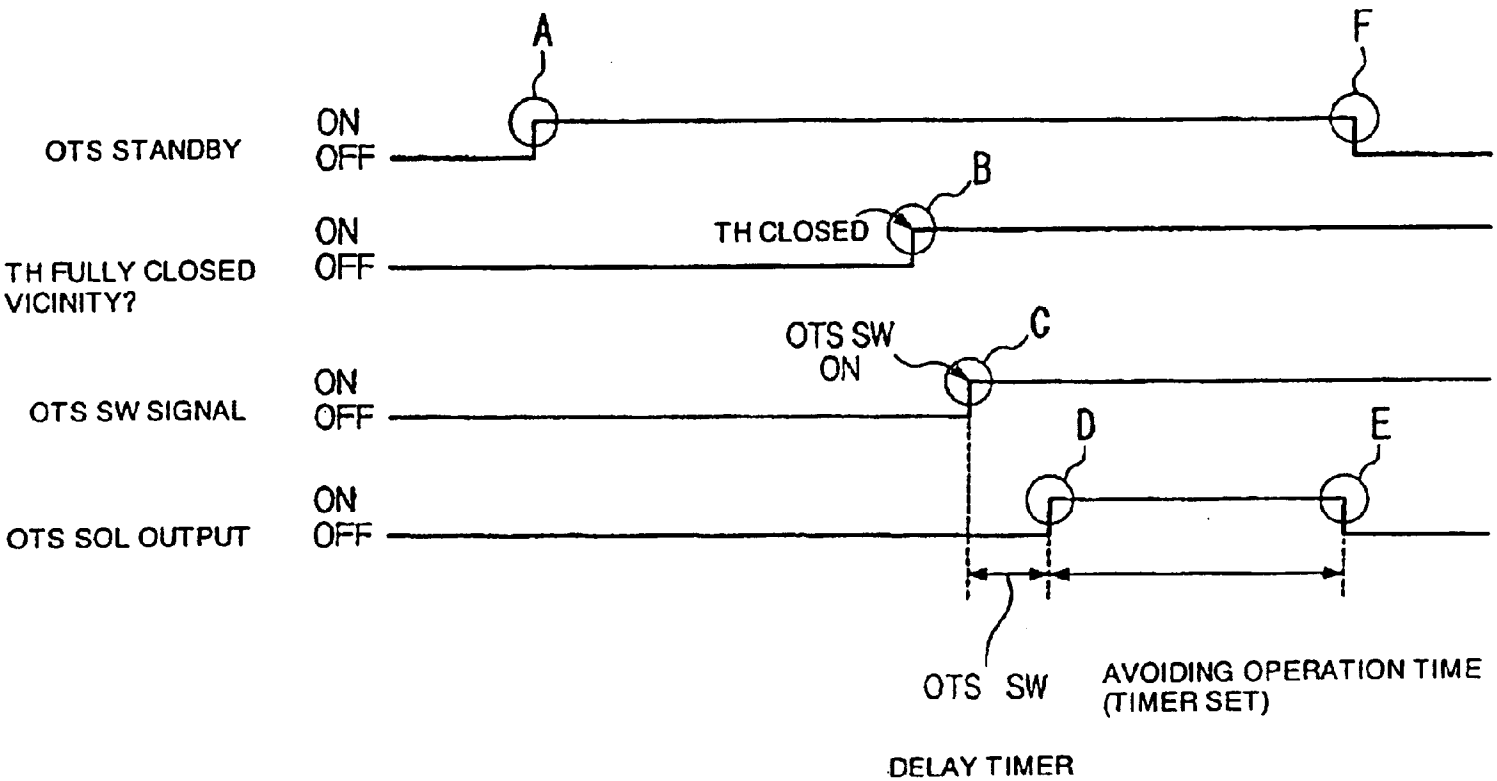
FIG. 6 is a timing chart showing OTS control.

That is, the controller 100 determines whether the input engine speed NE is equal to or exceeds a set value or not and whether the input throttle angle TH is equal to or exceeds a set value or not, and in case these conditions are met, a flag of an OTS standby is turned on for fixed time (A shown in FIG. 6). In the meantime, in case duration time does not meet set time or in case these conditions are not met, a flag of the OTS standby is not turned on. Even if a boat speed signal from a boat speed meter is turned on (for example, boat speed >30 kmph), a flag of the OTS standby may be also turned on.

Next, the controller 100 determines whether a flag for activating OTS is turned on or not (a step S2). In case the flag for activating OTS is turned on (1 in the step S2), the controller 100 determines whether the throttle angle TH is a preset throttle angle TH or less or not (a step S3). In the meantime, in case the flag for activating OTS is not on (0 in the step S2), the controller 100 proceeds to a normal control mode (a step S6).

In case the throttle angle TH is the preset throttle angle TH or less (Yes in the step S3, B shown in FIG. 6), the controller 100 further determines whether the steering handlebar 13 is in a state of full steering or not, which is input from the full steering switch 70 (a step S4).

In the meantime, in case the throttle angle TH exceeds the preset throttle angle TH (No in the step S3), the controller 100 proceeds to the normal control mode (the step S6). At this time, the set throttle angle includes a fully closed state or the vicinity of the fully closed state.

In case the full steering state of the steering handlebar 13 is sensed (Yes in the step S4, C shown in FIG. 6), the controller 100 sets a timer, controls the engine for fixed time (avoiding operation time) using the elapse of set time as a trigger and enhances thrust (a step S5, D and E shown in FIG. 6). That is, the controller 100 operates the throttle valve 81 of the engine 20 in an opened direction and has advance angle control over the ignition timing of the engine.

Concretely, the controller 100 outputs a turn-on signal to the solenoid 83, drives the diaphragm actuator 82 and operates the throttle valve 81 in the opened direction. Besides, the controller 100 corrects so that the ignition timing of the igniter is earlier than ignition timing calculated based upon engine speed for fixed time (avoiding operation time) and outputs an ignition signal to the igniter. At this time, the controller 100 controls the volume of fuel injected by the fuel injection system based upon the corrected result of the corresponding ignition timing.

The fuel injection system injects fuel according to the control of the controller 100 and the igniter ignites fuel earlier than the top dead center of a piston according to the ignition signal output by the controller 100.

Figure 7:
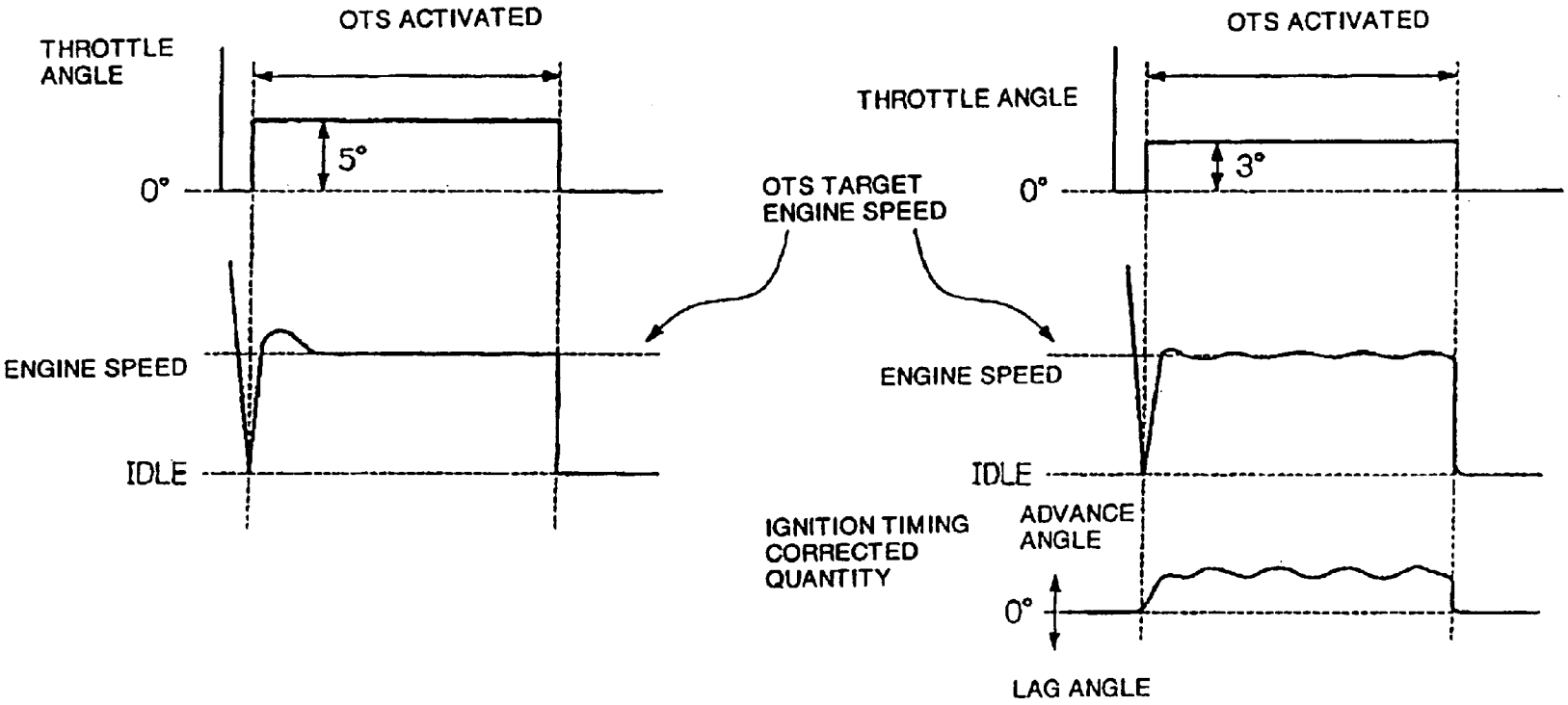
FIG. 7 is a graph showing mainly showing the variation in time of a throttle angle and engine speed.
Figure 8:
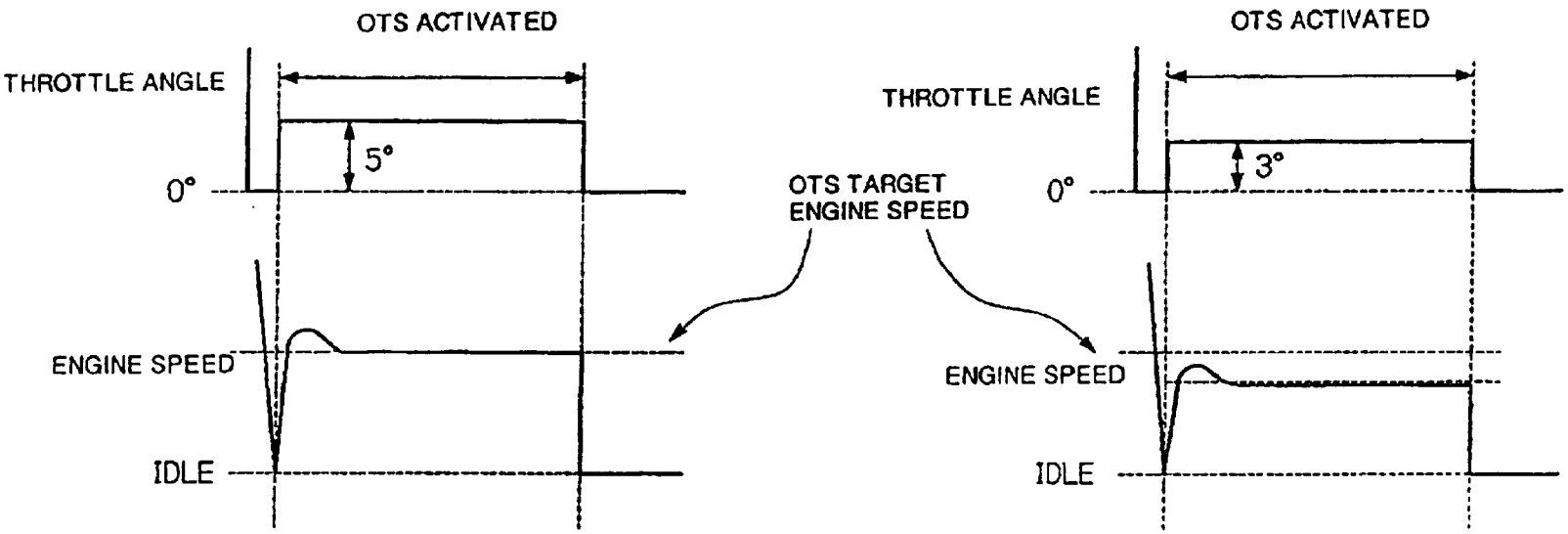
FIG. 8 is a graph showing the variation in time of a throttle angle and engine speed in a conventional system.

Ignition timing is made earlier by such advance angle control of ignition timing as shown in FIG. 7, compared with a case that no control is made (when a throttle angle is 5°) and in case a throttle angle is smaller (when a throttle angle is 3°), OTS target engine speed slightly higher than engine speed in idling can be also held.

As described above, according to the invention, as the throttle valve of the engine is operated in the opened direction and advance angle control is made over the ignition timing of the engine in case a throttle angle of the engine for driving the water jet pump is a predetermined value or less and a steering angle by the steering handlebar of the jet propulsion boat is a predetermined value or more, effect that steering control can be easily made even if the throttle valve is closed can be acquired.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An engine control unit for a boat propelled by jetting pressurized and accelerated water comprising:

a steering angle sensor;

a throttle angle sensor;

a throttle valve actuator;

a memory device adapted to store preset values of throttle angle and steering angle; and an ignition timing controller;

wherein the engine control unit switches from a normal mode to an advance angle control mode when the throttle angle sensor senses a throttle angle that is less than a preset value of throttle angle and the steering angle sensor senses a steering angle that is greater than a preset value of steering angle, wherein in the advance angle control mode the engine control unit biases the throttle valve actuator to define a greater throttle angle and causes the ignition timing controller to increase ignition timing.

2. The engine control unit according to claim 1, further comprising a fuel injection controller, wherein fuel injection parameters are changed when the engine control unit switches from the normal mode to the advanced angle control mode.

3. The engine control unit according to claim 1, further comprising an engine speed sensor.

* * * * *